US005119886A

United States Patent [19]

Fletcher et al.

[11] Patent Number: 5,119,886

[45] Date of Patent: Jun. 9, 1992

[54] HEAT TRANSFER CYLINDER

[75] Inventors: Leroy S. Fletcher; George P. Peterson, Jr., both of College Station, Tex.

[73] Assignee: The Texas A&M University System, College Station, Tex.

[21] Appl. No.: 426,831

[22] Filed: Oct. 25, 1989

[51] Int. Cl.[5] ..... F28D 15/02

[52] U.S. Cl. ..... 165/89; 165/86; 165/104.25

[58] Field of Search ..... 165/86, 89, 47, 104.25, 165/90

[56] References Cited

U.S. PATENT DOCUMENTS

| | | | |
|---|---|---|---|
| 3,619,539 | 11/1971 | Taylor | 165/89 |
| 3,801,843 | 4/1974 | Corman et al. | 165/104.25 |
| 3,842,596 | 10/1974 | Gray | 165/104.25 |
| 3,952,798 | 4/1976 | Jacobson et al. | 165/89 |
| 4,064,933 | 12/1977 | Schuman | 165/89 |
| 4,091,264 | 5/1978 | Sarcia | 165/89 |
| 4,105,896 | 8/1978 | Schuster | 165/89 |

FOREIGN PATENT DOCUMENTS

| | | | |
|---|---|---|---|
| 35388 | 3/1983 | Japan | 165/86 |
| 35389 | 3/1983 | Japan | 165/86 |
| 84086 | 5/1984 | Japan | 165/86 |
| 306321 | 6/1971 | U.S.S.R. | 165/104.25 |
| 577386 | 10/1977 | U.S.S.R. | 165/104.25 |

*Primary Examiner*—Albert W. Davis, Jr.
*Attorney, Agent, or Firm*—Arnold, White & Durkee

[57] ABSTRACT

A heat transfer method and apparatus are disclosed for transferring heat across a cylinder surface, in order to maintain the cylinder surface at a uniform temperature for drying, rolling or otherwise processing a work piece. The apparatus comprises a rotatable cylinder wall with a plurality of heat pipes bent near their evaporator ends and disposed within and around the periphery of the cylinder wall, at least one end wall, and a plurality of hubs interconnecting the cylinder with a drive shaft. The heat transfer cylinder, itself, may comprise a large rotating heat pipe.

29 Claims, 7 Drawing Sheets

FIG.4
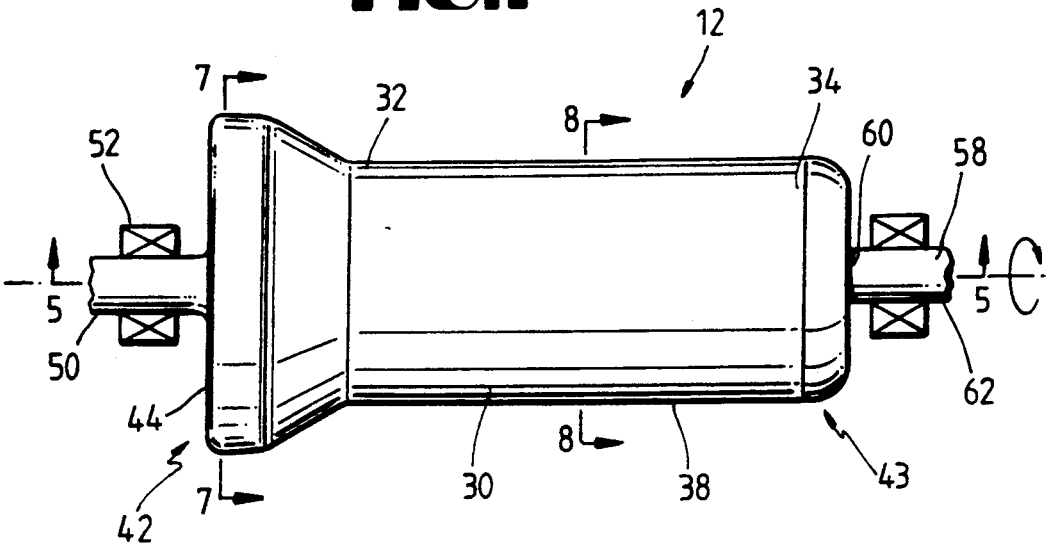
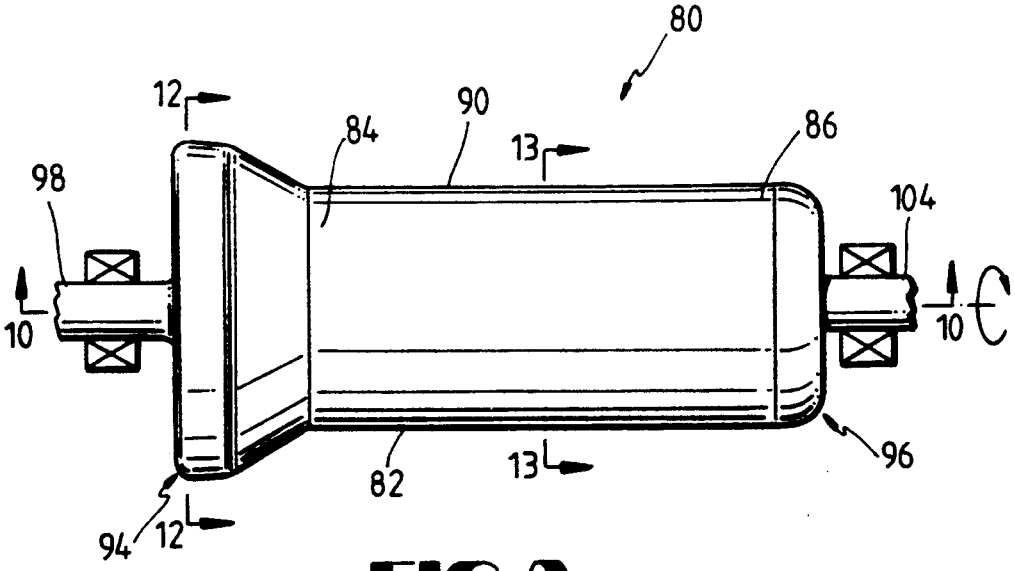
FIG.9

HEAT TRANSFER CYLINDER

BACKGROUND OF THE INVENTION

1. Field of the Invention

This invention relates generally to heat transfer apparatus, and more specifically, to a rotating heated cylinder for producing or processing materials or work pieces. Such cylinders may be used in a number of industries including the pulp and paper industry, various metal rolling industries, the food processing industry, the plastics industry, copy machines, laminating machines, and many other applications. The invention is of particular interest in the pulp and paper industry as a dryer and the metal rolling industry as a roller.

2. Related Art

Multicylinder drying systems currently used in the pulp and paper industry are composed of a series of cylinder dryers as schematically represented in FIG. 1. Such drying systems may use up to about 70 cylinders, but a typical newsprint or fine paper dryer system may use up to about 55 cylinders. The individual drying cylinders of these systems typically comprise rotating pressure vessels that are heated by pressurized steam. The use of pressurized steam as the heating medium for such dryers, however, has several disadvantages. First, to be even minimally effective, the steam in these cylinders must be heated to a temperature in excess of 350° F. At 350° F., the vapor pressure of steam is approximately 135 p.s.i.a. Thus, these cylinders must be constructed to meet pressure vessel codes and standards, making the manufacture of the cylinders expensive and difficult.

Second, as the steam contained inside the cylinders condenses, varying depths of condensate form on the cylinders' inner walls causing them to have a nonuniformly heated outer surface. Similarly, condensate and excess working fluid pools at the "bottom" of the cylinders as they rotate about their horizontal axes. This also impedes uniform heating. These problems, in turn, result in a nonuniform final product.

Third, the pressurized cylinders are inefficient and dangerous to operate. For example, as described above, varying depths of condensate on the inside of a cylinder cause nonuniform heating of the cylinder, and this results in a nonuniform final product (e.g. the paper to be contact dried in a pulp and paper mill is only partially dried). To correct this problem, additional energy is typically added in an attempt to achieve a uniform final product. This, of course, is inefficient. Likewise, the very necessity of meeting steam pressure vessel codes and standards suggests an element or possibility of danger associated with high pressure steam used in these cylinders.

Another problem with prior art cylinders occurs in the aluminum, copper, steel and other industries where metal sheets are rolled from ingots or other feedstock into sheets (see FIG. 2). In these applications, the inability of prior art cylindrical rollers to maintain a uniform roller temperature during rolling of the metal causes an undesirable variation in sheet thickness. As the ingots or other feedstocks are forced through gradually smaller and smaller roll press openings, the surface areas of the rollers coming in contact with the feedstocks heat up. At the ends of the individual rollers, the heat is more easily dissipated than near the middle of the rollers; therefore the rollers expand more around the middle. The result is inefficient use of materials, poor quality control, and variable strength characteristics in metal sheets having nonuniform thickness (i.e., there is a region in the middle of the final metal sheets where the metal is thinner than the outer sides of the sheets).

Various attempts have been made in prior art cylinders to alleviate some of the problems described above. For example, H. L. Smith, Jr., U.S. Pat. No. 3,228,462, describes a cylinder dryer that uses a fluid heat transfer medium, preferably liquid, which flows in opposite directions through two independent, interested labyrinthine flow channels around the periphery of the dryer cylinder. This working fluid is described preferably to be liquid hydrocarbons which may be heated to temperatures of 500°-800° F. and higher without boiling or decomposing to a significant extent. The patent further states that the heat transfer medium is circulated in liquid form at low pressure, eliminating the disadvantages attending high pressure steam and yet permitting higher surface temperatures to be obtained than are practical in steam heated drum dryers.

The cylinders described in the Smith reference, however, have various problems associated with them. For example, most drying facilities are already equipped with steam generating components. Therefore, to implement the Smith dryers on a large scale in already existing factories would be unduly expensive. Furthermore, manufacturing the internested labyrinthine flow channels disclosed in Smith, to achieve even a substantially uniformly heated cylinder, would be highly exacting, expensive and difficult. This is not to mention the expense and difficulty associated with manufacturing such channels and cylinders so that they do not leak the working fluid to undesired locations.

Hemsath, et al., U.S. Pat. No. 4,693,015, uses a direct firing burner which oxidizes fuel and directs hot combustion gases into the center of a dryer. The gases are then recirculated to nozzle assemblies contained in a plurality of extending boxes positioned around the periphery of the dryer cylinder. This system of direct firing of a flammable gas into each individual cylinder is inefficient, expensive and dangerous to operate. Moreover, most pulp and paper factories are equipped with steam heating components, and it would be expensive to replace them all with direct firing burners. Likewise, direct oxidation of a flammable fuel at up to 70 or more dryer cylinder locations, with the attendant possibility of fuel leaks and explosions, can be highly dangerous.

Schuster, U.S. Pat. No. 4,105,896, describes a double-walled hollow cylinder which is heated by an evaporation and condensation chamber formed between the inner and outer walls of the cylinder. This patent further states that the evaporation and condensation chamber has a larger outside diameter at either end of the cylinder than the outside diameter of the rest of the cylinder in between. The larger outside diameter, together with the inner cylinder wall, defines annular compartments or vapor generators at both ends of the cylinder. These annular compartments have steel wool packing in them to enhance vaporization. Upon heating a liquid working fluid contained in these annular compartments with an electrical slip ring/brush combination, the working fluid vapors travel from the annular compartments into the hollow cylindrical chamber defined by the inner and outer cylinder walls, thereby heating the cylinder surface that contacts a work piece.

Unfortunately, Schuster does not solve the problem of varying depths of condensate on the inner cylinder wall causing nonuniform heating of the working surface of the cylinder. Also, the problem of meeting pressure vessel requirements is only partly overcome to the extent that Schuster describes use of a carbon fluoride working fluid having a lower vapor pressure than other kinds of working fluids.

A heat pipe roller used in laminating and copy machines is described in Sarcia, U.S. Pat. No. 4,091,264, and Jacobson et al., U.S. Pat. No. 3,952,798. The heat pipe roller disclosed by these patents uses an internal, axially positioned, heat source and makes use of a wicking structure that extends radially from the heat source to cover the cylinder's inner surface. Likewise, the heat pipe roller of Sarcia and Jacobson contains a working fluid which is partially absorbed into the wicking structure and brought towards the heat source by capillary action, gravity and a paddle wheel-like action resulting from rotating the roller having radially extending wicking components inside.

The foregoing prior art rollers make no attempt to solve the need for costly and difficult pressure vessel construction. Also, such rollers are not suitable for high speed rotation necessary in many roller and cylinder dryer applications. This is because the working fluid of these rollers will be forced out away from the axial heat source as the roller rotates at higher and higher revolutions per minute (rpm's), and thus the working fluid will not be adequately vaporized. Such rollers are therefore limited to slow rotating applications. Also, the references describing these rollers show no awareness of the problems inherent in vaporizing a working fluid inside the roller itself (i.e., varying levels of condensate causing nonuniform heating, and the adverse effects on temperature uniformity of working fluid pooling at the "bottom" of the roller).

Heat pipes per se are well known. Generally, a heat pipe comprises a sealed tube containing a working fluid and a capillary structure. In choosing a suitable working fluid, one skilled in the art will consider the physical properties of the fluid and the desired characteristics of the heat transfer cylinder. "[T]he choice of a working fluid is dependent on physical properties of the fluid and compatibility of the fluid with the wicking structure. Among properties which will be considered by one skilled in the art are: vapor pressure, thermal conductivity, viscosity, and density of vapor and liquid" (see Sarcia, U.S. Pat. No. 4,091,264 citing Articles and U.S. Patents).

The capillary structure in a heat pipe may be made of any suitable material providing capillary attraction to a particular working fluid. For example, grooves etched into the heat pipe, wire lattices, and wicking material have all been used as capillary structures in heat pipes. Energy transfer within a heat pipe is basically accomplished in a cycle. To start the cycle, heat is applied to one end of the pipe (the evaporator part), thereby raising the temperature of the working fluid inside the pipe above its vaporization temperature. As the vapor leaves the evaporator portion of the heat pipe, it fills the rest of the pipe where the temperature is slightly lower than the evaporator part. This causes the vapor, now evenly distributed throughout the heat pipe to condense, thereby releasing additional thermal energy. To complete the cycle, the condensate is drawn back towards the evaporator through the above described capillary structure within the pipe.

SUMMARY OF THE INVENTION

The present invention overcomes many of the prior art problems through the use of a plurality of heat pipes in a heat transfer cylinder, in accordance with one aspect of the invention. Such a heat transfer cylinder is suitable for use in several situations including, but not limited to, the following: the pulp and paper industry, the metal rolling industry, the food processing industry, the plastics industry, copy machines, laminating machines etc.

As shown below, heat pipes are uniquely suited to transfer thermal energy uniformly across a rotating cylindrical surface for drying, rolling or otherwise processing a work piece. Thermal energy transfer within the individual heat pipes of the present invention occurs in a very efficient cycle. This cycle is begun by applying heat to a portion of the heat pipe. The portion of each heat pipe where heat is applied, is known as the evaporator portion of the heat pipe. In the first embodiment of the invention, that portion is preferably at the end of the heat pipe; however, it will be appreciated that the heat pipe may be heated at any location without departing from the scope of the invention.

As the working fluid within the evaporator portion of each heat pipe is raised above its vaporization temperature, vapor leaves the evaporator portion of each heat pipe and fills the rest of the pipe. Upon reaching the area of the pipe having a slightly lower temperature than the evaporator portion of the heat pipe—i.e., the condenser portion of the heat pipe—the vapor condenses, giving off thermal energy which is conducted to adjacent structures such as the outer cylinder surface.

To complete the cycle of thermal energy transfer within each heat pipe, the condensate is absorbed into the capillary structure within the heat pipe. This capillary structure may be made of any suitable material providing capillary attraction to a particular working fluid. For example, grooves etched into the heat pipe, wire lattices, and wicking material have all been used for this capillary structure.

The heat transfer cylinder of the first embodiment of the invention comprises a cylinder wall having first and second ends and inner and outer surfaces, or at least an outer surface in the case of a solid cylinder, and at least one end wall. These elements are preferably made of cast metal, but such material is not absolutely necessary. The cylinder wall of the heat transfer cylinder is adapted to carry a plurality of heat pipes which, upon continuous completion of the above described cycle, transfer thermal 15 energy uniformly to the outer surface of the cylinder wall which comes in contact with a work piece. To best accomplish uniform heating of the cylinder's outer surface, these heat pipes are preferably disposed longitudinally the length of the cylinder wall, and are preferably distributed frequently and evenly around the cylinder wall's circumference. The heat pipes may be mounted adjacent the inside surface of the cylinder wall or may be made integral with the cylinder wall as by investment casting, rotary casting with heat pipe cores, or insertion of heat pipes into preformed receptacles.

While a preferred position of the heat pipes in the present invention is longitudinally disposed and adjacent the inner surface of the cylinder wall, or integral with the cylinder wall, it will be appreciated by those skilled in the art that other heat pipe configurations relative to the cylinder wall will be possible without departing from the scope of the invention.

A preferred embodiment of the invention further provides that the cylinder wall is engaged at its first and second ends by a hub: namely a steam chest hub rigidly joined to the first end of the cylinder wall and an open hub rigidly joined to the second end of the cylinder wall.

The steam chest hub, in a preferred embodiment of the invention, is in the shape of a hollow truncated cone with a large closed end and a smaller open end. This steam chest 10 hub is mounted at its open end to the first end of the cylinder wall, and adjacent the evaporator portions of the heat pipes. Thus, the evaporator portions of the heat pipes extend beyond the first end of the cylinder wall, through the end wall enclosing the first end of the cylinder wall, 15 and into the enclosed cavity formed by the steam chest hub and the end wall. The steam chest hub is joined to the cylinder wall by welding or other suitable means to the first end of the cylinder sealing the cavity formed between the first end wall and the steam chest hub. At its closed end, the steam chest hub is rigidly mounted to a drive shaft. Thus, the steam chest hub interconnects the cylinder wall with the drive shaft which rotates the cylinder about its axis during operation.

In another aspect of a preferred embodiment of the invention, the drive shaft does not extend through the cylinder, but instead ends at or inside the steam chest hub. Another shaft is rigidly connected at one end to the open hub rigidly joined to the second end of the cylinder wall. At its other end, this other shaft is mounted on a bearing fixture allowing rotation of the shaft. Therefore, this other shaft works together with the drive shaft allowing the heat transfer cylinder to rotate about its axis.

Of course, it will be apparent to those skilled in the art that a single drive shaft keyed or otherwise rigidly attached to the hubs and extending through the area defined by the cylinder wall can be used. Likewise, any well known motor and drive system may be employed to rotate the drive shaft and thereby rotate the heat transfer cylinder which is, in effect, an integrated heat pipe cylinder or roller.

Further, the steam chest hub is adapted to receive a steam input line from the drive shaft. Once the steam input line enters the steam chest hub from the drive shaft, it branches radially into a plurality of steam input lines (or passageways) ending in nozzles, with preferably one steam input line corresponding to each heat pipe. These steam input lines are disposed within the steam chest hub with their nozzles adjacent the evaporator portion of each heat pipe to spray hot steam thereon during operation of the cylinder.

Likewise, the steam chest hub is adapted to house condensate removal tubes (or passageways) with openings inside the steam chest hub. These tubes carry condensate forming within the steam chest hub to the steam generator. To accomplish this, the condensate removal tubes branch radially from an inner concentric shaft entering the steam chest hub through the outer drive shaft, the openings of the tubes being positioned inside and near the periphery of the steam chest hub where condensate collects by centrifugal forces during rotation of the hub. To drain the condensate, a vacuum is created in the condensate removal tubes which sucks the condensate out of the steam chest hub and carries it to a steam generator.

To enhance condensate removal from the steam chest hub, the hub is preferably in the form of a hollow truncated cone as described above having open and closed ends. Thus, upon rotation of the cylinder wall and hub, condensate within the hub is forced by centrifugal force to collect near the closed end of the steam chest hub (i.e., the end where the diameter of the steam chest hub is greater than the open end of the hub sealed to the first end of the cylinder wall).

The use of steam through the steam chest hub is only one preferred way, among many other well known ways, of 10 heating the evaporator portions of the heat pipes. For example, an electrical slip ring/brush combination, direct fire combustion, hot gases, or other well known methods of heating may be suitably used in the present invention without departing from its scope. Likewise, those skilled in the art will note that it is not necessary to heat the ends of the individual heat pipes or cylinder wall with an external heat source; instead, the pipes or cylinder wall may be heated internally and/or at varying locations along the pipes with varying degrees of efficiency.

At the second end of the cylinder opposite the end rigidly joined to the steam chest hub, the cylinder wall is rigidly joined to an open hub, e.g., a hub containing holes in it. The open hub is suitable since it is not necessary to enclose the second end of the cylinder wall in this embodiment of the invention because the working fluid used in this embodiment of the invention is contained within the individual heat pipes of the cylinder. However, though an open hub is preferable because it uses less material and weighs less, a solid hub may be used. The center of the open hub is rigidly connected to a shaft that is mounted on bearings to allow rotation of the heat transfer cylinder.

While several additional hubs may be disposed throughout the cylinder for various purposes well known to those skilled in the art, a preferred embodiment of the invention only uses two hubs as above described.

During operation of the thermal transfer cylinder, thermal energy is uniformly transferred across the outer surface of the cylinder wall. Basically, operation of the cylinder consists of rotating the cylinder about its axis, heating the evaporator portions of the heat pipes disposed within the cylinder, and removing steam condensate from the steam chest hub. As the heat pipes undergo heating at their evaporator portions, they commence the thermal energy transfer cycle above described, imparting heat typically by conduction and/or thermal radiation to surrounding structures, most importantly to the adjacent outer cylinder 15 surface coming in contact with the work piece. As noted earlier, the work piece can be paper in a paper dryer assembly, a composite laminate in a laminating machine, a rolled piece of dough in a dough rolling machine, an ingot of steel, aluminum or copper in a metal rolling mill or a piece of paper in a copy machine.

In another aspect of the invention, the heat pipes are bent slightly outwardly so that the diameter formed by the evaporator portions of the heat pipes is slightly larger than the diameter formed by the condenser portions of the heat pipes. This aspect of the invention enhances the transfer of thermal energy in the individual heat pipes as the cylinder containing the heat pipes is rotated at higher rpm's thereby improving the efficiency of the cylinder.

For example, currently in the pulp and paper industry, many cylinder dryers operate at approximately 200–300 rpm's with six foot cylinder diameters. However, those skilled in the pulp and paper industry desire to operate between 300–500 rpm's and possibly higher with up to eight foot diameter cylinders. The present invention is particularly suited to achieve such results because the desired larger diameter cylinder surfaces can easily be uniformly heated by using more heat pipes in the cylinder. Furthermore, the higher the rotational velocity of the cylinder, the more efficiently the cylinder surface is heated because of the outwardly bent pipes described above. In other words, the higher the rotational velocities in the particular application, the more efficient is the cylinder of the present invention at transferring thermal energy across the cylinder's outer surface. On the other hand however, this advantageous characteristic of the invention at high rpm's does not adversely affect the improved efficiency of the invention over prior art cylinders at very low rpm's.

Heat pipes are particularly suited to the transfer of heat across a cylindrical rolling or drying surface because of high efficiency in providing thermal energy transport across the surface of the cylinder, and the heat pipe's ability to quickly dissipate localized concentrations of heat from any area of the cylinder surface. The velocity of the vapor within the individual heat pipes is very fast, having been measured approaching Mach one. Also, the heat transfer process described above is driven by a very minimal temperature gradient between the evaporator portions and the condenser portions of the heat pipes. Indeed, it is a well known characteristic that the transfer of large quantities of energy in heat pipes, being an isothermal transfer process, can be accomplished at a wide range of temperatures, both high and low. Furthermore, heat pipes can easily be made to the precise length of the outer cylinder surface contacting the work piece so that heat is evenly distributed longitudinally the length of the surface. Likewise, the size and number of heat pipes can be varied so that circumferential uniformity is achieved and maintained constant.

The present invention allows the surface temperature of the cylinder to be maintained uniformly at the desired temperature. This is achieved by directly and simultaneously applying the same temperature heat source (e.g., steam, direct firing oxidation, electricity, etc.), to all the evaporator portions of the heat pipes. Thus, to being, there is virtually no temperature loss or difference between the evaporator portions of the heat pipes. This initial temperature uniformity at the evaporator portions of the heat pipes is maintained as thermal energy is transferred along the heat pipes, for it is a well known and measured characteristic of heat pipes to quickly, consistently and uniformly conduct thermal energy along their length with virtually no temperature drop. Thus, the temperature along the heat pipes, and hence along the cylinder surface, is uniform. In regard to maintaining temperature uniformity, it is also a well known characteristic of heat pipes of dissipate heat from sources other than the desired heat source (e.g., heat from friction between the work piece and the cylinder). Hence, the cylinder is not only efficiently and uniformly heated by the heat pipes, but it is also maintained at a uniform temperature during operation of the cylinder despite heat input to the cylinder from other sources.

All of these considerations make the heat pipe particularly suited to maintain a uniformly heated cylinder surface under the various conditions in which such cylinders are used. The heat transfer cylinder of the invention thereby addresses the problems left unsolved by prior art cylinders. For example, the invention helps to eliminate condensate on the cylinder wall's inner surface, and thus alleviates the problem of nonuniform heating attributed to varying depths of condensate on the cylinder wall's inner surface. Likewise, the present invention is more efficient because there is no longer the need for extra heating of the cylinder in an attempt to compensate for nonuniform temperatures due to varying depths of condensate inside the cylinder.

Furthermore, the need for pressure vessel construction of the cylinder is no longer necessary because only the heat pipes contain pressurized vapor, not the cylinder itself. This, in turn, reduces the expense of producing such cylinders because less material is needed and stringent pressure vessel codes need not apply. Since the cylinder walls themselves are not subject to vapor pressure, maintenance is easier and less frequent and operation of the cylinder is therefore safer than prior art cylinders.

An alternative embodiment of the invention comprises the application of the heat pipe principle to a rotating cylinder for drying, rolling or otherwise producing or processing a work piece. As with the first embodiment of the invention described above, this embodiment of the invention comprises an end wall enclosing the first end of the cylinder wall and two hubs, a steam chest hub and a closed hub. Likewise, the methods of heating and rotating this second embodiment of the invention are substantially identical to those in the first embodiment of the invention.

The steam chest hub used with the second embodiment of the invention is virtually identical to the steam chest hub in the first embodiment of the invention, serves substantially the same purposes, and is joined to the cylinder wall and drive shaft in basically the same way. Likewise, this embodiment of the invention also comprises virtually identical steam input lines and condensate removal tubes. These components function in the same way, and are positioned similarly to corresponding components in the first embodiment of the invention. However, the steam input lines of the second embodiment of the invention are preferably slightly longer and positioned differently than their counterparts in the first embodiment. This allows direct spraying of steam onto the first end of the cylinder wall itself as required in the second embodiment.

Further, in the second embodiment of the invention, the hub joined to the second end of the cylinder wall is a closed hub. Unlike the corresponding open hub in the first embodiment, this closed hub does not have holes in it because it must enclose and seal the hollow cylinder formed by the cylinder wall and the end wall. As with the open hub of the first embodiment, the closed hub of the second embodiment is also rigidly mounted on a shaft other than the drive shaft. In this manner, the closed hub interconnects the heat transfer cylinder with the other shaft.

It will be recognized that either single or dual shafts may be used to rotate the second embodiment of the invention and that more than two hubs may be used. Likewise, as described above, it will be understood that the second embodiment of the invention is also suitably heated by other well known heat sources such as electricity, direct fire oxidation and others. Furthermore, it is apparent that the second embodiment of the invention may be used in all of the same situations as the first embodiment.

Inasmuch as thermal energy is applied to the first end of the cylinder wall in the second embodiment of the invention, this first end of the cylinder wall becomes the evaporator portion of the cylinder, and the rest of the cylinder wall is the condenser portion of the cylinder. Though applying heat to the end of the cylinder wall, as described above, is preferred, those skilled in the art will see that the heat source may be directed at any portion of the cylinder wall, making that portion the evaporator portion and the rest of the cylinder wall the condenser portion.

Unlike the first embodiment of the invention where individual heat pipes contain the capillary structure and the working fluid, the inside surface of the cylinder wall of the second embodiment is preferably lined with a capillary structure (e.g., grooves, wires, wicking material or other material serving a capillary function), and the cylinder itself is adapted to receive and contain the working fluid.

During operation of the second embodiment of the invention, heat is applied to the evaporator portion of the rotating cylinder itself in much the same way as heat is applied to evaporator portions of the heat pipes of the first embodiment. This causes the working fluid sealed inside the cylinder wall, end wall and closed hub to vaporize and fill the rest of the cylinder. After leaving the evaporator portion of the cylinder, the vapor gradually cools and condenses. The heat given off during condensation is transferred by conduction to the outer surface of the cylinder. The condensate is then reabsorbed into the capillary structure etched or otherwise provided on the inner surface of the cylinder, and is brought back towards the evaporator portion of the cylinder through capillary and/or centrifugal forces.

In accordance with another aspect of this second embodiment, the evaporator portion of the cylinder is flared outwardly so that the diameter of the evaporator end of the cylinder is slightly larger than the diameter of the rest of the cylinder. In this manner, additional acceleration forces are added which, in addition to otherwise existing centrifugal and/or capillary forces, move condensate more rapidly away from the condenser portion of the cylinder and towards the evaporator portion of the cylinder. These forces enhance the transfer of thermal energy across the cylinder and become greater as the cylinder is rotated at higher and higher speeds. This is especially significant, as described above, since some applications require that the heat transfer cylinder of the present invention operate at very high rotational velocities. Indeed, the flared structure of the present embodiment, used in conjunction with the inner capillary structure regulating the working fluid depth on the cylinder walls, greatly enhances the efficiency of the present invention over prior art cylinders.

As described above, heat pipes are particularly suitable for rotating cylinders for drying, rolling or otherwise processing a work piece. This is also true with the second embodiment of the invention. The heat transfer cylinder of the second embodiment of the invention achieves a high degree of conductance, heat dissipation, and constant uniform heating across the cylinder's outer surface. In addition, the advantageous properties of high speed vapor travel and isothermal energy transfer exist in the second embodiment of the invention. Indeed, the various characteristics described above demonstrate the applicability of general heat pipe principles to cylinders used for drying, rolling, or otherwise processing a work piece.

The second embodiment of the present invention addresses many of the problems left unsolved by prior art cylinders. For example, the addition of a capillary structure into the cylinder, especially when the cylinder rotates at high speeds, serves to control the depth of working fluid/condensate on the inside surface of the cylinder wall. Likewise, unlike conventional steam cylinder dryers and rollers, only a relatively small, predetermined amount of liquid is present inside the cylinder. This is due to the fact that the cylinder is sealed once the working fluid is introduced, with the heat source being external to the cylinder walls. To the contrary, conventional steam cylinders spray steam directly into the cylinder so that condensate pools at the "bottom" of the cylinder and exists at varying depths on the cylinder's inner surface. These considerations demonstrate the ability of the second embodiment of the present invention to achieve a more efficiently and uniformly heated outer cylinder surface. Likewise, the flaring of the evaporator portion of the cylinder improves the transfer of thermal energy across the cylinder surface, and makes the heat transfer cylinder of the present invention more efficient than prior art cylinders.

Just like the first embodiment of the invention, the second embodiment of the invention can be advantageously used in many applications including: the pulp and paper industry, various metal rolling industries, the food processing industry, the plastics industry, copy machines, laminating machines, and others. Applied in such areas of commerce, the second embodiment of the invention will greatly enhance efficiency, quality of produces and profitability.

The subject matter of the present invention is particularly pointed out and distinctly claimed in the concluding portion of this specification. However, both the organization and method of operation of the invention, together with further advantages thereof, may best be understood by reference to the following description taken in connection with the accompanying figures wherein like reference characters refer to like elements.

BRIEF DESCRIPTION OF THE DRAWINGS

FIG. 4 is a side view elevation of a heat transfer cylinder in accordance with the first embodiment of the present invention;

FIG. 9 is a side view elevation of a heat transfer cylinder in accordance with a second embodiment of the invention;

DETAILED DESCRIPTION OF THE DRAWINGS

Figure 1:
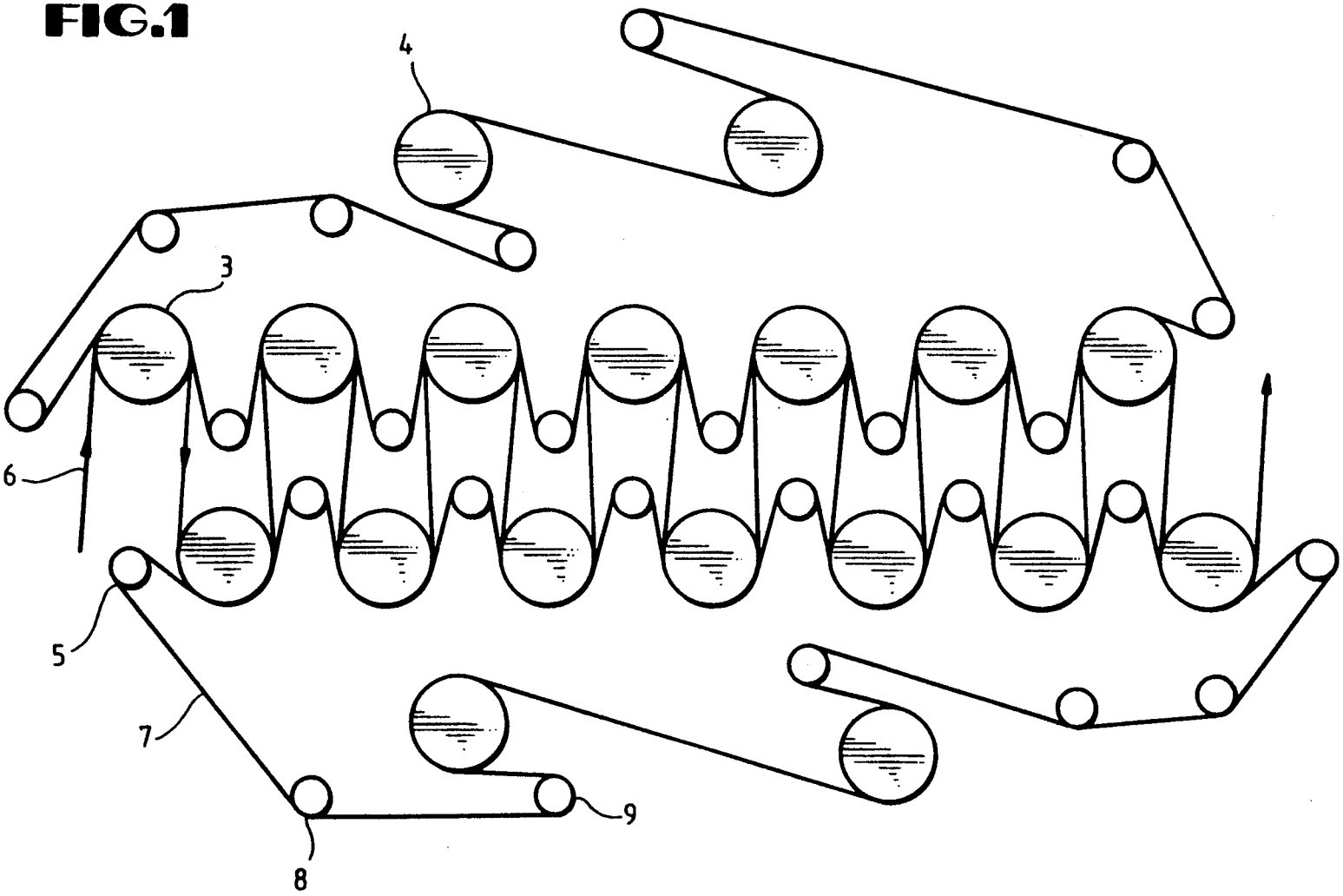
FIG. 1 is a partial schematic representation of a typical drying system in the pulp and paper industry.
Figure 2:
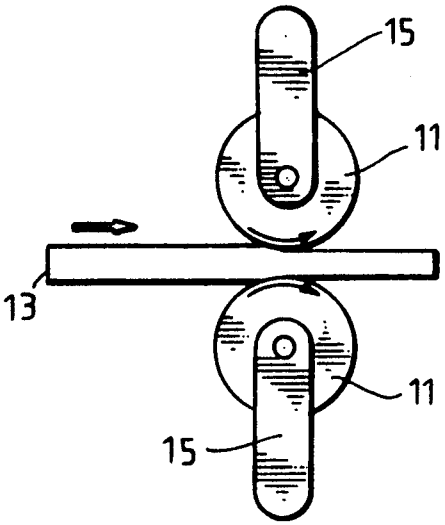
FIG. 2 is a partial schematic representation of a metal rolling mill.
Figure 3:
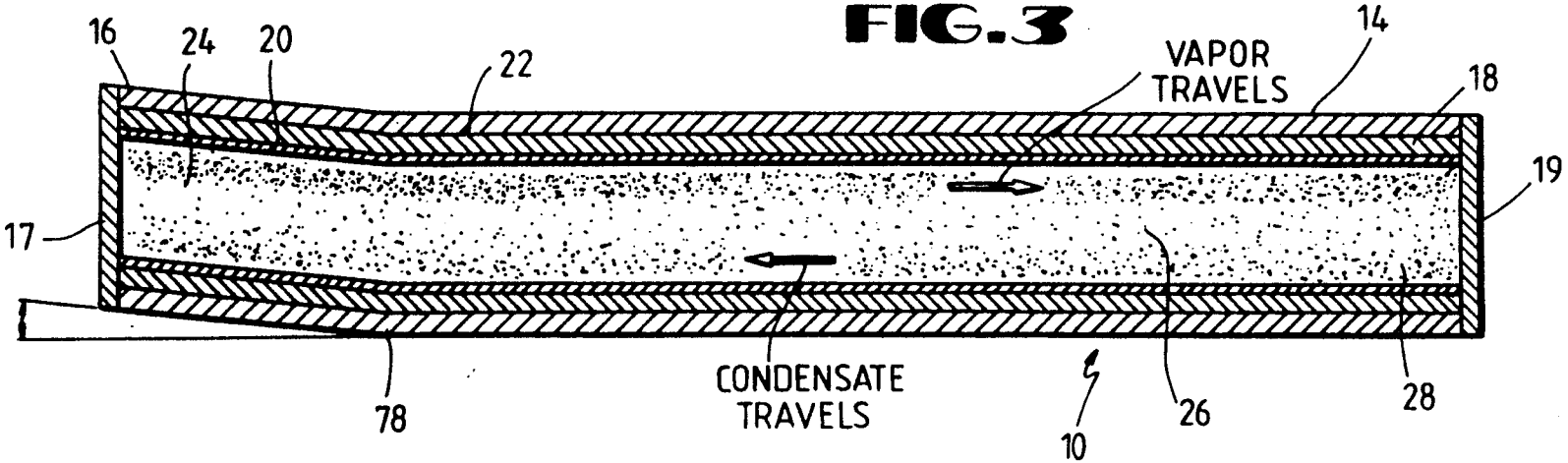
FIG. 3 is a longitudinal cross-section view of an individual heat pipe of the first embodiment of the present invention.
Figure 5:
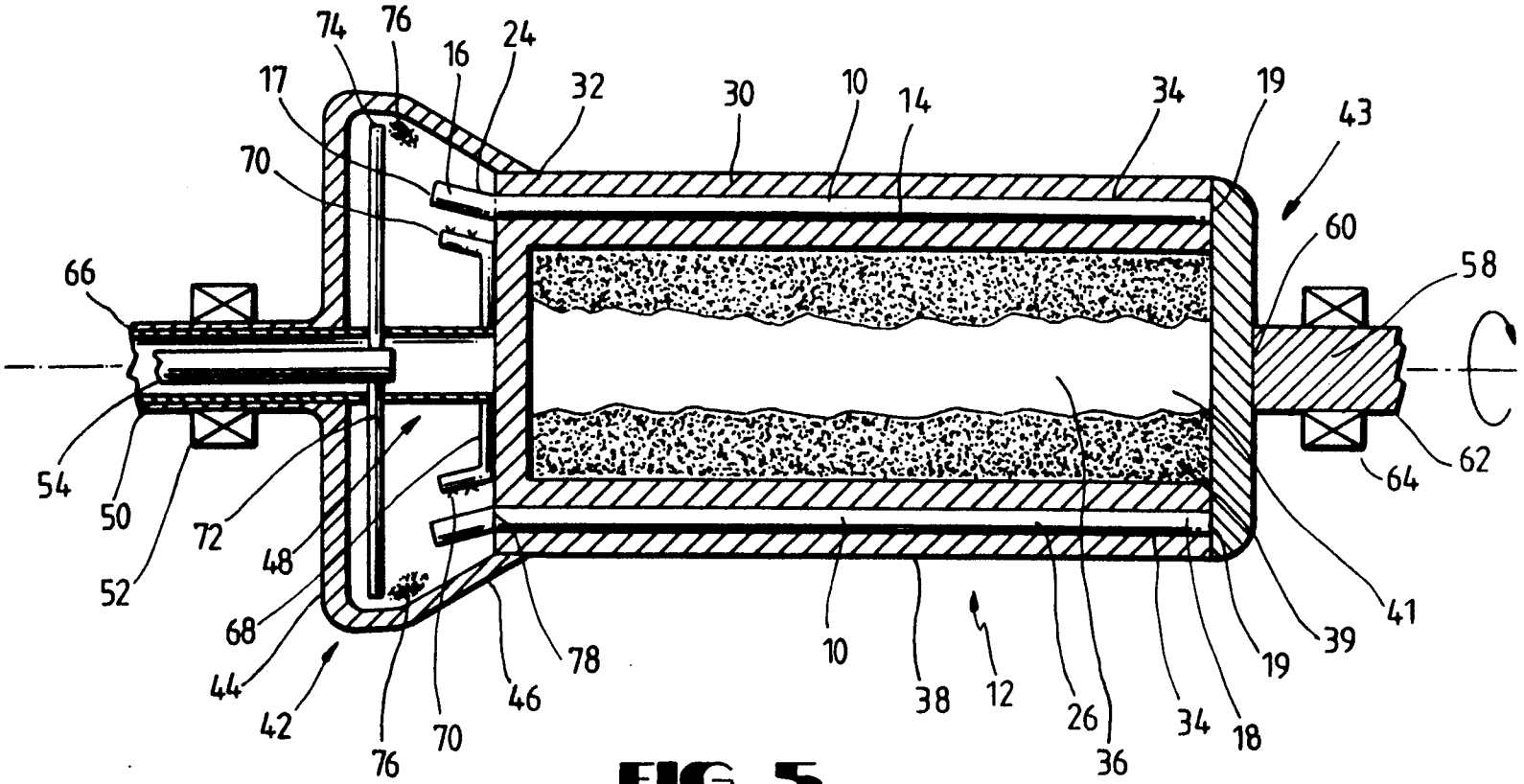
FIG. 5 is a longitudinal cross-section view of the heat transfer cylinder of FIG. 4 taken at line A—A.
Figure 8:
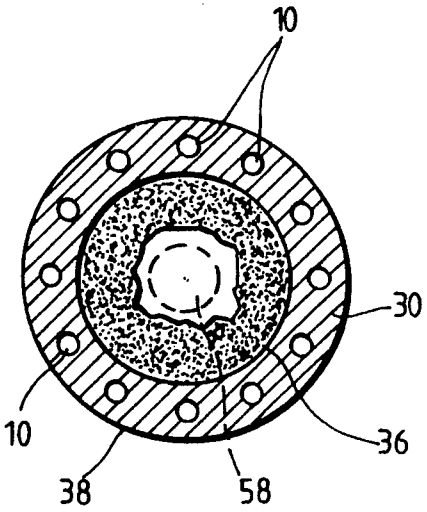
FIG. 8 is a cross-section view of the heat transfer cylinder of FIG. 4 taken at line B—B.
Figure 7:
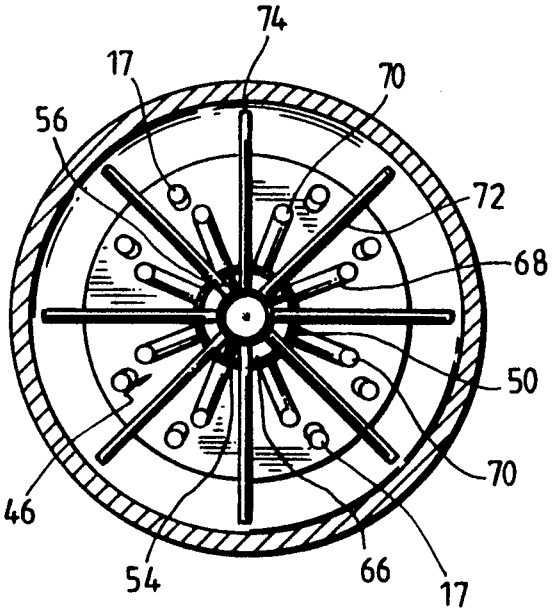
FIG. 7 is a cross-section view of the steam chest hub, the drive shaft, the inner concentric shaft, the steam input lines and the condensate removal tubes of FIG. 4 taken at line E—E.
Figure 6:
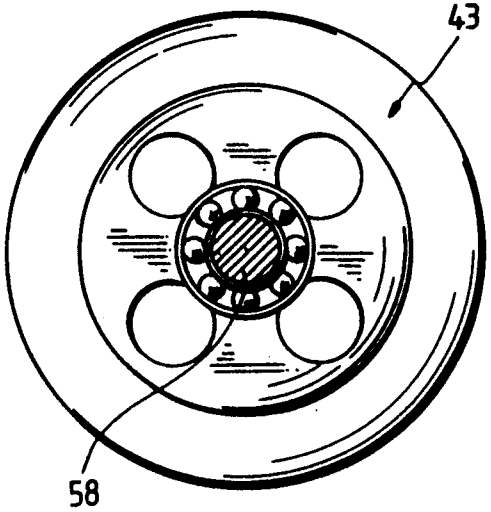
FIG. 6 is an end view of the open cylinder hub of the heat transfer cylinder of FIG. 4.
Figure 10:
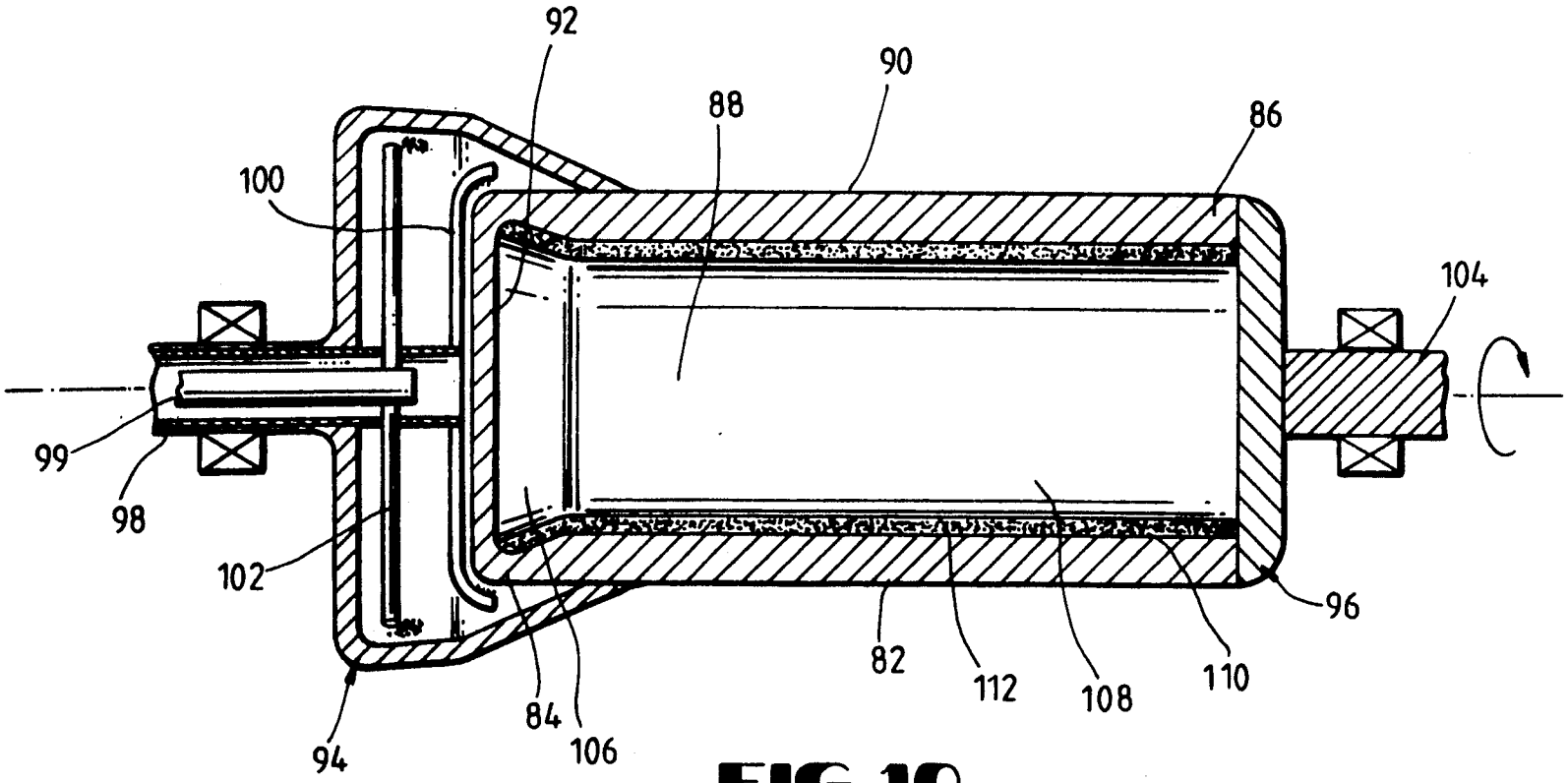
FIG. 10 is a longitudinal cross-section view of the heat transfer cylinder of FIG. 9 along line C—C.
Figure 13:
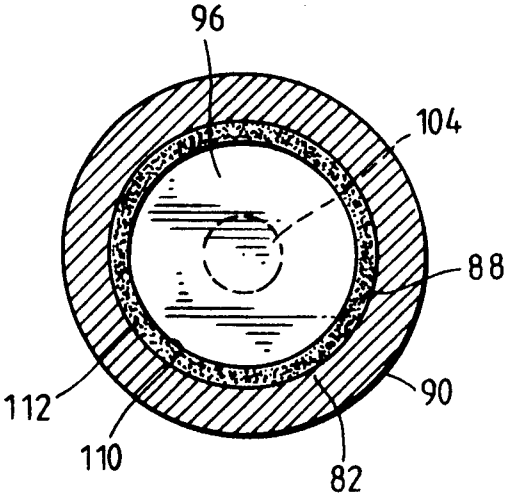
FIG. 13 is a cross-section view of the heat transfer cylinder of FIG. 9 taken along line D—D.
Figure 12:
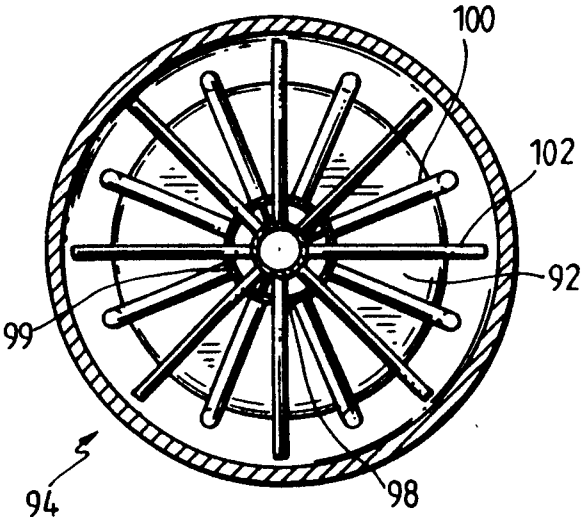
FIG. 12 is an end view of the steam chest hub of the heat transfer cylinder of FIG. 9.
Figure 11:
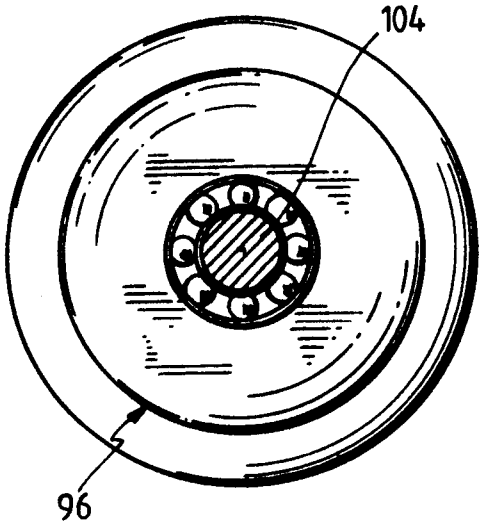
FIG. 11 is an end view of the solid hub of the heat transfer cylinder of FIG. 9.

Referring to FIGS. 3–8 of the drawings, a heat transfer cylinder in accordance with a first embodiment of the present invention is shown. The first embodiment of the invention uses a plurality of heat pipes 10 in the heat transfer cylinder 12 for drying, rolling or otherwise processing a work piece. As described in further detail below, such heat pipes are uniquely suited to heat transfer cylinders as used in various applications including, but not limited to, the following: the pulp and paper industry, various metal rolling industries, the food processing industry, the plastics industry, copy machines, laminating machines, and many others. Depending on the application involved, one or many heat transfer cylinders 12 may be used in a system to accomplish a desired result (e.g., drying paper or flattening feedstock as illustrated in FIGS. 1 and 2). For example, FIG. 1 schematically illustrates part of a cylinder dryer system typical in a pulp and paper mill. Such a system generally comprises: cylinder dryers 3, felt dryer cylinders 4, felt rolls 5, paper 6, felt 7, felt guides 8 and felt stretchers 9, all working together in a system for drying paper as shown. The present invention would be of use in any of the dryers in such a system. For another example, FIG. 2 schematically illustrates part of a roller assembly in a metal rolling mill where cylinder rollers 11 are mounted on frame 15 so that they can rotate about their axes to reduce the thickness of feedstock 13 (e.g. steel, aluminum or copper). The present invention would also apply to such cylinder rollers 11.

Referring again to FIGS. 3–8, a heat pipe 10, one of the plurality of heat pipes used in heat transfer cylinder 12, is shown. Heat pipe 10 preferably comprises an elongated tube 14 having first and second ends 16 and 18 sealed by end caps 17 and 19. Elongated tube 14 of heat pipe 10 also contains a working fluid/condensate 20 absorbed in a capillary structure 22 (e.g., grooves, wires, wicking material or the like).

In one embodiment of the invention, heat is preferably applied to the first end 16 of heat pipe 10, raising working fluid/condensate 20 to its vaporization temperature. Thus, in this first embodiment of the invention, the first end 16 of the heat pipe 10 is the evaporator portion 24 of the heat pipe, and the rest of the heat pipe is the condenser portion 26. Nonetheless, it will be apparent to those skilled in the art that heat pipes 10, as used in the present invention, may be heated at differing areas without departing from the scope of the invention.

Upon raising the working fluid/condensate 20 above its vaporization temperature, vapor 28 leaves the evaporator portion 24 of the heat pipe 10 and fills the entire heat pipe. Upon reaching the condenser portion 26 of the heat pipe 10, the vapor 28 condenses giving off thermal energy.

Turning specifically to FIGS. 4–8, heat transfer cylinder 12 comprises a cylinder wall 30 with first and second ends 32, 34 and inner and outer surfaces 36, 38. Heat transfer cylinder 12 further comprises at least one circular end wall 40 that is joined to the cylinder wall 30, and which encloses the cylinder adjacent the first end of the cylinder wall. Lining the inner surface 36 of the cylinder wall 30 is insulation 39, which serves to reduce heat loss into a hollow space 41 formed by the cylinder wall and end wall 40. While a preferred embodiment of the invention comprises a hollow cylinder (i.e., the cylinder wall 30 having inner and outer surfaces 36, 38), it will be apparent to those skilled in the art that a solid cylinder may be used in the present invention.

In accordance with the first embodiment of the invention, the heat pipes 10 of heat transfer cylinder 12 are preferably disposed longitudinally the length of the cylinder wall 30, and are distributed substantially evenly around the periphery of the cylinder wall. These heat pipes 10 may be mounted adjacent t he inner surface 36 of the cylinder wall 30 or may be made integral with the cylinder wall as by investment casting, rotary casting with heat pipe cores, or insertion of heat pipes into preformed receptacles.

While a preferred position of the heat pipes 10 in the present invention is longitudinally adjacent or integral with the inner surface 36 of the cylinder wall 30, it will be appreciated by those skilled in the art that other heat pipe configurations relative to the cylinder wall will be possible without departing from the scope of the invention.

The first embodiment of the heat transfer cylinder 12 of the invention further comprises cylinder wall 30 being rigidly joined at its first end 32 to a steam chest hub 42, while the second end 34 of the cylinder wall is rigidly joined to an open hub 43.

The steam chest hub 42, in a preferred embodiment of the invention, is shaped like a hollow truncated cone or a bell with a large closed end 44 and a smaller open end 46. Steam chest hub 42 is rigidly joined at its open end 46 to the first end 32 of the cylinder wall 30 adjacent the evaporator portions 24 of the heat pipes 10. Thus, the evaporator portions 24 of the heat pipes 10 extend beyond the first end 32 of the cylinder wall 30, through the end wall 40 enclosing the first end of the cylinder wall, and into the enclosed cavity 48 formed by the steam chest hub 42 and the end wall 40. The steam chest hub 42 is joined by welding or other suitable means to the first end 32 of the cylinder wall 30, sealing the cavity 48 formed between the end wall 40 and the steam chest hub 42. At its closed end 44, the steam chest hub 42 is rigidly mounted to a hollow drive shaft 50 supported by bearings 52 and extending from a motor or other driving device (not shown).

Thus, the steam chest hub 42 interconnects the cylinder wall 30 with the drive shaft 50. In this manner, the drive shaft 50 rotates the cylinder wall 30, the heat pipes 10 mounted to or integral with the cylinder wall, the end wall 40, the steam chest hub 42 and the open hub 43, about the drive shaft axis during operation of heat transfer cylinder 12. Positive rotation of the heat transfer cylinder 12 about drive shaft 50 is attained by well known methods, such as keying the drive shaft to the hubs 42, 43 or otherwise.

In the first embodiment of the invention, drive shaft 50 ends at or just inside the steam chest hub 42. Also, as further shown in FIG. 7, drive shaft 50 is preferably hollow, having an inner concentric shaft 54 disposed longitudinally within and interconnected to the drive shaft by fins 56. Another shaft 58, having first and second ends 60, 62, is rigidly connected, at its first end 60, to the open hub 43, the open hub being rigidly joined to the second end 34 of the cylinder wall 30. This other shaft 58 is mounted at its second end 62 to a fixture with bearings 64 so that heat transfer cylinder 12, being driven by drive shaft 50, is free to rotate about its axis. Thus, shaft 58 works together with the drive shaft 50 to rotate the heat transfer cylinder 12 about its axis and the axes of the shafts.

Despite the use of a plurality of shafts in the first embodiment of the invention, it will be apparent to those skilled in the art that a single drive shaft (not shown), extending along the longitudinal axis of the heat transfer cylinder 12, may be used to rotate the heat transfer cylinder about its longitudinal axis without departing from the scope of the invention.

Steam chest hub 42 is further adapted to receive a steam input line 66, being the annular space formed between inner concentric shaft 54 and the drive shaft 50. Once the steam input line 66 enters the steam chest hub 42 through the drive shaft 50, it branches radially into a plurality of steam input lines 68 ending in nozzles 70, preferably with one steam input line 68 corresponding to each heat pipe 10. These radially branching steam input lines 68 are disposed within the steam chest hub 42 with their nozzles 70 adjacent the evaporator portion 24 of each heat pipe 10 to spray steam thereon.

Likewise, the steam chest hub 42 is adapted to house condensate removal tubes 72 having openings 74. Within the steam chest hub 42, these condensate removal tubes 72 branch radially from the inner concentric shaft 54 so that the openings 74 of the condensate removal tubes 72 are located near the periphery of the steam chest hub and adjacent its closed end 44. So positioned, the openings 74 of these condensate removal tubes 72 can receive pooled condensate 76, the condensate having been forced radially outwardly and towards closed end 44 of the steam chest hub 42 by centrifugal force. Thereupon, condensate removal tubes 72 carry condensate 76 towards inner concentric shaft 54 which then carries the condensate to an external steam generator (not shown). To perform this draining of the condensate 76, a vacuum is created in the inner concentric shaft 54 and the condensate removal tubes 72, the vacuum serving to suck the condensate from steam chest hub 42 through the condensate removal tubes and into the inner concentric shaft.

The above described truncated cone shaped design of the steam chest hub 42 enhances removal of condensate 76 from the steam chest hub. This is because the diameter at closed end 44 of steam chest hub 42, near which the openings 74 of condensate removal tubes 72 are located, is greater than the diameter of the steam chest hub at open end 46 joined to cylinder wall 30. Thus, upon rotation of the cylinder 12 (including rotation of steam chest hub 42), condensate 76 within steam chest hub 42 is centrifugally forced to collect near the closed end 44 of the steam chest hub.

Those skilled in the art will realize that the use of steam input lines 68 and condensate removal tubes 72 is only one method of transferring steam to heat pipes 10 and condensate from the steam chest hub. For example, passageways (not shown) serving the same purpose may be cast into the steam chest hub itself. Also, while several additional hubs (not shown) may be disposed throughout the cylinder formed by the cylinder wall 30, for various purposes well known to those skilled in the art, a preferred embodiment of the invention only uses the two hubs 42, 43 as above described. Likewise, the use of steam through the steam chest hub 42 is only one preferred way, among many other well known ways, of heating the evaporator portions 24 of the heat pipes 10. For example, an electrical slip ring/brush combination with electric heaters, direct fire combustion, hot gases, or other well known methods of heating may be suitably used in the present invention without departing from its scope. Furthermore, those skilled in the art will note that it is not necessary that the heat pipes 10 be heated at their first ends 16 and in the same manner as described and shown above. Instead, those skilled in the art will appreciate that the scope of the invention allows that the heat pipes may be heated by either an external or internal heat source and/or at varying locations along the heat pipes.

At the second end 34 of the cylinder wall 30, opposite the first end 32 joined to the steam chest hub 42, the cylinder wall is rigidly joined to an open hub 43, for example, a hub containing holes in it. Open hub 43 is suitable for the present invention because it is not necessary to enclose the cylinder wall 30 in this embodiment of the invention; the working fluid used in this embodiment of the invention is contained within the individual heat pipes 10 of the heat transfer cylinder 12. However, though an open hub 43 is preferable because it uses less material and weighs less, a solid hub without any holes may be used. At its center, the open hub 43 is rigidly connected to shaft 58 that is mounted on bearings 64 to allow rotation of the heat transfer cylinder 12. In view of the rigid connections between the drive shaft 50, the steam chest hub 42, the cylinder wall 30, the open hub 43, and the other shaft 58, it is apparent that these elements, together with the steam input lines 68 and condensate removal tubes 72, rotate as a whole, in fixed relation to one another.

During rotation of the cylinder 12, steam is applied to the evaporator portion 24 of heat pipes 10 which heats working fluid/condensate 20 located in the evaporator 15 portions of the heat pipes. Upon raising the working fluid/condensate 20 above its vaporization temperature, vapor 28 leaves the evaporator portions 24 of the heat pipes 10 and fills the heat pipes. Upon reaching the condenser portions 27 of the heat pipes 10, where the temperature is slightly lower than the evaporator portions 24, the vapor 28 condenses giving off thermal energy. That thermal energy is typically radially conducted, or to the extent such thermal energy is transferred through the air, thermally radiated, to the outer surface 38 of the cylinder wall 30, because the outer cylinder surface is adjacent the heat pipes 10. The uniformity achieved across the entire outer surface 38 of the cylinder wall 30 depends on the frequency of location of heat pipes 10 around the periphery of the cylinder wall and the length of the heat pipes relative to the length of the cylinder wall.

As mentioned above, it is important that the thermal energy imparted to the outer cylinder surface 38 is uniform, because it is the outer cylinder surface that comes in contact with a work piece (not shown). To uniformly dry, heat or roll a work piece, the temperature of the heat transfer cylinder doing the drying, heating or rolling must itself be uniform. The invention provides such temperature uniformity to the outer surface 38 of cylinder wall 30 of heat transfer cylinder 12.

To complete the cycle of thermal energy transfer within the heat pipes 10, the working fluid/condensate 20 is reabsorbed into the capillary structure 22 within the heat pipe 10. In effect, the above described cycle repeatedly updates and evenly distributes the thermal energy along the individual heat pipes 10 in an extremely efficient and fast manner. This is very important in maintaining a uniform temperature on outer cylinder surface 38. For example, when localized heat from friction is imparted to the outer cylinder surface 38 from repeated contact with a metal ingot, such localized heat is quickly distributed throughout the heat pipes 10, and hence throughout the entire cylinder surface. Thus, the temperature on cylinder surface 38 stays uniform, and the thermal expansion along the outer cylinder surface stays uniform, so that the resulting metal sheet is of uniform thickness.

In accordance with another aspect of the invention, the heat pipes 10 are bent slightly outwardly at 78 so that the diameter formed by the evaporator portions 24 of the heat pipes is slightly larger than the diameter formed by the condenser portions 27 of the heat pipes. This aspect of the invention enhances the transfer of thermal energy in the individual heat pipes 10 as the heat transfer cylinder 12 is rotated at high rpm's, thereby improving the efficiency of the cylinder.

Heat pipes are particularly suited to the transfer of heat across a cylindrical rolling or drying surface. This is due to the high efficiency of heat pipes in providing thermal energy transport and the heat pipe's ability to quickly dissipate localized concentrations of heat. The efficiency of heat pipes is partly due to the fact that velocity of the vapor within the individual heat pipes is very fast. Also, the heat transfer process described above is driven by a very minimal temperature gradient between the evaporator portions and the condenser portions of the heat pipes. Indeed, it is a well known characteristic that the transfer of large quantities of energy in heat pipes, being an isothermal transfer process, can be accomplished at a wide range of temperatures, both high and low. Furthermore, heat pipes 10 can easily be made to the precise length of the outer cylinder surface 38 contacting the work piece so that heat is evenly distributed longitudinally the length of the surface. Likewise, the size and number of heat pipes can be varied so that circumferential uniformity is achieved and maintained constant.

Temperature uniformity of outer cylinder surface 38 is further enhanced by the way the invention applies heat to the heat pipes 10 of cylinder 12. Accordingly, steam input lines 68 simultaneously apply the same temperature heat source directly to all the evaporator portions 24 of the heat pipes 10, so that there is virtually no temperature loss or difference between the individual heat pipes to start with. To continue this uniform beginning temperature among the evaporator portions 24 of the heat pipes 10, it is a well known characteristic of heat pipes to conduct thermal energy along the length of the heat pipes with a minimum of temperature drop from the evaporator portions of the heat pipes to the condenser portions. Hence, the temperature uniformity of the outer cylinder surface 38 is further enhanced by the very characteristics of the heat pipes 10 disposed within cylinder 12.

The heat transfer cylinder 12 of the present invention addresses the problems left unsolved by prior art cylinders.

For example, the use of a plurality of heat pipes 10 around the periphery of the cylinder wall 30 helps to eliminate condensate on the cylinder wall's inner surface 36, thus also helping to eliminate the problem of nonuniform heating attributed to varying depths of condensate on the cylinder wall's inner surface. Likewise, the heat transfer cylinder 12 of the present invention is more efficient, because there is no longer the need for extra heating of the cylinder in an attempt to compensate for nonuniform temperatures due to varying depths of condensate inside the cylinder.

Furthermore, the need for pressure vessel construction of the heat transfer cylinder 12 of the present invention is not necessary, because only the heat pipes 10 contain pressurized vapor 28, not the cylinder itself. This, of course, reduces the expense of producing such cylinders 12 because less material is needed and stringent pressure vessel codes do not apply. Since the cylinder wall 30 itself is not subject to vapor pressure, maintenance is easier and less frequent, and operation of the heat transfer cylinder 12 is safer than prior art cylinders.

Referring now to FIGS. 9–13, a heat transfer cylinder 80, in accordance with a second embodiment of the invention, is likewise suitable for drying, rolling or otherwise processing a work piece. Like its first embodiment counterpart, heat transfer cylinder 80 comprises a cylinder wall 82 with first and second ends 84, 86 and inner and outer surfaces 88, 90, and end wall 92 enclosing the first end 84 of the cylinder wall 82. A steam chest hub 94 is rigidly joined to the first end 84 of the cylinder wall 82, and a closed hub 96 is rigidly joined to the second end 86 of the cylinder wall.

The steam chest hub 94 of the second embodiment is virtually identical to the steam chest hub 42 of the first embodiment, serves substantially the same purposes, and interconnects the cylinder wall 82 with a drive shaft 98 containing an inner concentric shaft 99.

Heat transfer cylinder 80 also comprises steam input lines 100 communicating with hollow drive shaft 98, and condensate removal tubes 102 communicating with hollow inner concentric shaft 99. Steam input lines 100 and condensate removal tubes 102 function basically in the same way and are positioned similar to their corresponding components in the first embodiment of the invention. However, the steam input lines 100 of cylinder 80 are slightly longer and positioned differently than their first embodiment counterparts to allow direct spraying of steam onto the first end 84 of the cylinder wall 82.

The heat transfer cylinder 80 of the second embodiment also comprises a closed hub 96. Unlike the corresponding open hub 43 of the first embodiment, this closed hub 96 does not have holes in it because it must enclose and seal the hollow cylinder formed by the cylinder wall 82 and the end wall 92. As with the open hub 43 of the first embodiment, the closed hub 96 rigidly interconnects the cylinder wall 82 to another shaft 104. Thus, just like the heat transfer cylinder 12 of the first embodiment of the invention, heat transfer cylinder 80 is driven by a drive shaft 98 and can rotate about its axis on the drive shaft and shaft 104.

As can be seen by those skilled in the art, the methods of heating and rotating this second embodiment of the invention are nearly identical to those in the first embodiment of the invention. As described in connection with the first embodiment of the invention, other methods of heating and rotating the heat transfer cylinder 80 of the second embodiment of the invention will be apparent to those skilled in the art. Also, as will be appreciated by those skilled in the art, a single drive shaft (not shown) may be used to rotate the second embodiment of the invention about two or more hubs. Like its first embodiment counterpart, 10 the second embodiment of the invention is also suitably heated by other well known heat sources such as electrical slip ring/brush combination, direct fire oxidation and others.

Inasmuch as thermal energy is applied to the first end 84 of the cylinder wall 82, the first end of the cylinder wall becomes the evaporator portion 106, leaving the rest of the cylinder, defined by the cylinder wall and closed hub 96, to be the condenser portion 108 of the invention. Though applying heat to the end of the cylinder wall is preferred, those skilled in the art will see that the heat source may be directed, with varying degrees of efficiency, at any portion of the cylinder wall 82.

Unlike the first embodiment of the invention, where individual heat pipes 10 contain the capillary structure 22 and the working fluid/condensate 20, the second embodiment uses a capillary structure 110 (e.g., grooves, wires, wicking material or other material serving a capillary function) which is fixed adjacent the inner surface 88 of the cylinder wall 82. Likewise, unlike its first embodiment counterpart, heat transfer cylinder 80 is adapted to receive and contain working fluid/condensate 112 within the cylinder wall 82 itself, not within individual heat pipes inside the cylinder wall.

During operation of heat transfer cylinder 80, heat is applied to the evaporator portion 106 of the rotating cylinder in much the same way as heat is applied to evaporator portions 24 of the heat pipes 10 of the first embodiment. This causes the working fluid/condensate 112, being sealed inside the cylinder wall 82, end wall 92 and closed hub 96, to vaporize and fill the above described cylinder. After leaving the evaporator portion 106 of the cylinder 80, the vapor gradually cools and condenses giving off thermal energy which is transferred by conduction to the outer surface 90 of the cylinder. The working fluid/condensate 112 is then reabsorbed into the capillary structure 110 etched or otherwise fixed on or adjacent the 15 inner surface 88 of the heat transfer cylinder 80. Once the working fluid/condensate 112 is reabsorbed into the capillary structure 110, it is brought back towards the evaporator portion 106 of the cylinder through capillary and/or centrifugal forces.

In accordance with another aspect of the second embodiment of the invention, the evaporator portion 106 of the cylinder wall 82 is flared outwardly so that the diameter of the evaporator portion of the cylinder wall is slightly larger than the diameter of the rest of the cylinder wall. In this manner, additional acceleration forces exist during rotation of the cylinder. These forces, in addition to otherwise existing centrifugal and/or capillary forces, move working fluid/condensate 112 in capillary structure 110 more rapidly away from the condenser portion 108 of the cylinder 80 and towards the evaporator portion 106 of the cylinder. This enhances the transfer of thermal energy across the cylinder's surfaces 88, 90.

When used as a dryer cylinder in the pulp and paper industry, the heat transfer cylinder 80 typically may be rotated in excess of 300 rpm's. At these high rpm's, heat transfer and temperature uniformity across outer surface 90 are enhanced by virtue of the increased acceleration forces due to high rotational velocity and the enlarged diameter of the evaporator portion 106 of the cylinder 80. In other words, the higher the rotational velocities of the heat transfer cylinder 80, the more efficient the transfer of thermal energy across the cylinder's outer surface 90. This increase in thermal energy transfer efficiency provides for more uniform and constant heating of the cylinder surface and a more uniform final product.

Furthermore, the flared design of the evaporator portion 106 of the second embodiment, used in conjunction with the inner capillary structure 110 regulating the working fluid/condensate 112 depth on the inner surface 88 of the cylinder wall 82, greatly enhances the efficiency of the present invention over prior art cylinders. These same considerations prevail for the first embodiment of the invention, wherein the acceleration forces within individual heat pipes 10 are increased due to high rotational velocities and bending of the heat pipes outward at 78 as described above.

The particular applicability of heat pipe principles to a cylinder, as demonstrated in the second embodiment of the invention, is apparent. Because of the high degree of conductance and heat dissipation achievable with a heat pipe design, more constant and uniform heating is available with heat transfer cylinder 80 than prior art cylinders. Indeed, the various characteristics showing the applicability of heat pipes 10 to the heat transfer cylinder 12 described above, also suggest the applicability of the heat pipe principle in general to cylinders used to dry, roll or otherwise process a work piece. The advantageous properties of high speed vapor travel and isothermal energy transfer characteristic in heat pipes, exist in the second embodiment of the invention as well, and render the second embodiment of the invention more efficient and uniformly heated than prior art cylinders.

Accordingly, heat transfer cylinder 80 of the second 10 embodiment of the present invention addresses many of the problems left unsolved by prior art cylinders. For example, the addition of a capillary structure 110 into the cylinder 80, especially when the cylinder rotates at high speeds, serves to control the working fluid/condensate 112 on the inner surface 88 of the cylinder wall 82. Likewise, unlike conventional steam cylinder dryers and rollers, only a relatively small predetermined amount of liquid (i.e., working fluid/condensate 112) is present inside the heat transfer cylinder 80. This is due to the fact that the cylinder 80 is sealed after the working fluid/condensate 112 is introduced, and the heat source is externally applied to the evaporator portion 106 of the cylinder wall 82. To the contrary, conventional steam cylinder dryers spray steam directly into a cylinder, and the condensate pools at the bottom of the cylinder and exists at varying depths on the inner cylinder surface. Likewise, as described in detail above, the flaring of the evaporator portion 108 of the cylinder 80 improves energy transfer across the cylinder wall's outer surface 90, which lends to the superior performance of the second embodiment of the heat transfer cylinder 80 over prior art cylinders.

Finally, just like the first embodiment of the invention, the second embodiment of the invention can be advantageously used in several industries including: the pulp and paper industry, various metal rolling industries, the food processing industry, the plastics industry, copy machines, laminating machines, and other applications. Applied in such areas of commerce, the second embodiment of the invention will greatly enhance efficiency, quality of products and profitability.

While preferred embodiments of the present invention have been shown and described, it will be apparent to those skilled in the art that many changes and modifications may be made without departing from the invention in its broader aspects. The appended claims are therefore intended to cover all such changes and modifications as followed in the true spirit and scope of the invention.

We claim:

1. A heat transfer cylinder for drying or otherwise processing a work piece, said cylinder comprising: a cylinder rotatable about its longitudinal axis and having an outer cylindrical wall surface; and a plurality of heat pipes mounted within said cylinder and adapted to transfer thermal energy to said outer cylindrical wall surface, each said heat pipe comprising an evaporator portion and a condenser portion, said evaporator portion of each said heat pipe extending sufficiently outward relative to said longitudinal axis to increase the transfer of thermal energy to said outer cylindrical wall surface during high speed rotation of said cylinder.

2. A cylinder in accordance with claim 3, wherein said cylinder further comprises an inner cylindrical wall surface, and wherein said condenser portions of said heat pipes are disposed longitudinally within the cylinder and essentially parallel to its longitudinal axis.

3. A cylinder in accordance with claim 2, wherein said heat pipes are substantially evenly spaced around the periphery of said cylinder and wherein said condenser portions within said cylinder are adjacent said inner cylindrical wall surface.

4. An integrated heat pipe cylinder in accordance with claim 2, wherein said condenser portions of said heat pipes within said cylinder are integral with said cylinder, said condenser portions of said heat pipes being disposed between said inner and outer cylinder surfaces.

5. A cylinder dryer for use in drying pulp or paper comprising: a cylinder rotatable about its longitudinal axis and having an outer cylinder wall surface adapted to contact said pulp or paper; and a plurality of heat pipes mounted within said cylinder and adapted to transfer thermal energy to said outer cylinder wall surface, each said heat pipe comprising an evaporator portion extending outward relative to said longitudinal axis.

6. A cylinder roller for use in reducing the thickness of a work piece, said cylinder roller comprising: a cylinder rotatable about its longitudinal axis and having an outer cylinder wall surface adapted to contact the work piece; a plurality of heat pipes mounted within said cylinder and adapted to transfer thermal energy to said outer cylinder wall surface, each said heat pipe comprising an evaporator portion extending outward relative to said longitudinal axis.

7. A heat transfer cylinder for drying or otherwise processing a work piece, said cylinder comprising: a cylinder rotatable about its longitudinal axis and having an inner and an outer cylinder surface; a plurality of heat pipes mounted within said cylinder, each said heat pipe comprising an evaporator portion extending beyond one end of said cylinder and outward relative to said longitudinal axis, and a condenser portion within said cylinder; said condenser portions within said cylinder being longitudinally disposed within said cylinder and around the periphery of said cylinder; means for imparting thermal energy to said evaporator portion of said heat pipes; and means for rotating said cylinder.

8. A heat transfer cylinder in accordance with claim 7, wherein said means imparting thermal energy to said heat pipes comprises a source of steam.

9. A heat transfer cylinder in accordance with claim 7, wherein said means for rotating said cylinder comprises at least one shaft rotatable about its longitudinal axis and attached to said cylinder.

10. A heat transfer cylinder in accordance with claim 9, wherein said means for rotating said cylinder further comprises a hub interconnecting said one shaft and said cylinder.

11. A heat transfer cylinder for drying or otherwise processing a work piece, said cylinder comprising: a cylinder rotatable about its longitudinal axis and having inner and outer cylinder surfaces and first and second ends; a plurality of closed heat pipes capable of holding a vaporizable liquid, each said heat pipe comprising an evaporator portion and a condenser portion capable of condensing vapor from the evaporator portion, said evaporator portion extending beyond one end of said cylinder and outward relative to said longitudinal axis, said evaporator portion also being partially within said cylinder, and said condenser portion being within said cylinder, said heat pipes being mounted in fixed relation within said cylinder; means for imparting thermal energy to said evaporator portion of said heat pipes; a first hub interconnecting said first end of said cylinder with a rotatable drive shaft; and a second hub interconnecting said second end of said cylinder with said drive shaft.

12. A heat transfer cylinder in accordance with claim 11, wherein said second hub is open.

13. A heat transfer cylinder in accordance with claim 11, wherein said first hub has a truncated conical shape having a larger diameter, closed first end and a smaller diameter, open second end, said first hub defining a hollow cavity such that said evaporator portions of said heat pipes extend into said hollow cavity defined by said first hub.

14. A heat transfer cylinder in accordance with claim 13, wherein said first hub partially houses said means imparting thermal energy to said heat pipes.

15. A heat transfer cylinder in accordance with claim 14, wherein said means imparting thermal energy to said heat pipes comprises a plurality of steam input lines aimed at said evaporator portion of each said heat pipe, and a plurality of condensate removal tubes having openings positioned near the periphery of said first end of said first hub.

16. A heat transfer cylinder in accordance with claim 15, wherein said steam input lines and said condensate removal tubes are cast inside said first hub.

17. A heat transfer cylinder for drying or otherwise processing a work piece, said cylinder comprising: a cylinder rotatable about its longitudinal axis and having inner and outer cylinder wall surfaces and first and second ends; an end wall enclosing said first end of said cylinder; a plurality of heat pipes, each said heat pipe comprising an evaporator portion and a condenser portion, the evaporator portion of each said heat pipe extending through said first end of said cylinder, through said end wall and outward relative to said longitudinal axis, said condenser portions being longitudinally disposed and mounted within said cylinder and around the periphery of said cylinder, said heat pipes being adapted to transfer thermal energy to said outer cylinder wall surface.

18. A heat transfer cylinder for drying or otherwise processing a work piece, said cylinder comprising:

a cylinder having at least an outer cylinder surface and first and second ends;

a plurality of heat pipes disposed longitudinally the length of said cylinder and mounted within and in a fixed relation to said cylinder, each said heat pipe having first and second ends, each said heat pipe having an evaporator portion and a condenser portion, and each said heat pipe being bent at an angle and positioned so that the diameter formed by the evaporator portions of said heat pipes is larger than the diameter formed by the condenser portions of said heat pipes;

means for imparting thermal energy to said evaporator portion of each said heat pipe, said means comprising a steam input line adapted for spraying steam at said evaporator portion of each said heat pipe, and a plurality of condensate removal tubes adapted for removing condensate; and first and second hubs, said first hub interconnecting said cylinder with a drive shaft, said second hub interconnecting said cylinder with another shaft.

19. A heat transfer cylinder in accordance with claim 18, wherein said evaporator portion of each heat pipe is at said first end of each heat pipe, said evaporator portion of each heat pipe being positioned so that it extends beyond said first end of said cylinder and into said first hub, and wherein said means imparting thermal energy to said evaporator portions of said heat pipes is partially contained in said first hub such that said steam input lines spray steam on said evaporator portions of said heat pipes within said first hub, and such that said condensate removal tubes adapted for carrying away condensate are positioned inside and near the periphery of said first hub.

20. A heat transfer cylinder in accordance with claim 19, wherein said first hub is partially hollow, and wherein said first hub comprises a closed first end and an open second end, said first end being mounted to said drive shaft, and said open end being joined to said first end of said cylinder to form a hollow cavity adjacent said first end of said cylinder, said closed end of said first hub having a larger inside diameter than the inside diameter of said open end of said first hub.

21. A heat transfer apparatus, comprising: a rotatable, cylindrical member having an outer surface and a longitudinal axis; a plurality of heat conducting pipes arranged within said cylindrical member essentially parallel to said longitudinal axis thereof and adjacent said outer surface, each said heat conducting pipe comprising an evaporator portion extending beyond a first end of said cylindrical member and outward relative to said longitudinal axis to enhance the transfer of thermal energy during high speed rotation of said cylinder; a fluid sealed within said heat conducting pipes, said fluid being capable of successively and repeatedly vaporizing and condensing to transfer thermal energy along said cylindrical member and to said outer surface; and means for heating said evaporator portions of said heat conducting pipes in order to cause at least a portion of said fluid to vaporize and to thereby transfer and impart heat to said outer surface.

22. The apparatus as defined in claim 21, further including means for causing said fluid, upon condensing, to travel to the heat portion of each said heat conducting pipe.

23. The apparatus as defined in claims 21 and 22, further including a chamber at said first end of said cylindrical member, and wherein said evaporator portion of each said heat conducting pipe is at an end of each heat conducting pipe and extends into said chamber.

24. A method of transferring heat to the outer wall surface of a cylindrical member rotatable about its longitudinal axis, comprising the steps of: providing a plurality of heat conducting pipes adjacent to and interiorly of the outer wall surface of said cylindrical member; applying heat to a portion of said pipes extending outward relative to said longitudinal axis, and causing a fluid within said pipes to vaporize and convey heat from said portion to other portions of the pipes and thereby to the outer surface of said cylindrical member; whereupon the vaporized fluid condenses for subsequent and repeated vaporization for heat transfer.

25. The method defined in claim 24, further including the step of conveying the condensed fluid back to that portion of the pipe where heat is applied.

26. Apparatus for processing work pieces such as paper, paper pulp, metal sheets and ingots, which comprises: a cylindrical member rotatable about its longitudinal axis, said cylindrical member including first and second ends and an outer wall surface adapted to receive and contact a work piece; a plurality of heat pipes disposed along and within said cylindrical member and distributed about the periphery of said cylindrical member, each of said heat pipes including an evaporator portion proximate said first end which extends longitudinally beyond said outer wall surface and gradually outwardly along the length of said evaporator portion relative to the longitudinal axis, and a condenser portion being generally parallel to an disposed in heat transfer relation with said outer wall surface; and a capillary structure disposed along and within said heat pipe and extending between said evaporator and condenser portions.

27. The apparatus of claim 26 which further comprises a hub attached to said first end of the cylindrical member and defining a cavity which also houses said outwardly bending evaporator portions.

28. The apparatus of claim 26 which further comprises a first line penetrating the hub along said longitudinal axis capable of supplying a heating fluid into said cavity.

29. The apparatus of claim 28 which further comprises a second line penetrating the hub along said longitudinal axis and capable of venting said cavity, and a plurality of radially disposed conduits within said hub communicating at their radially inner ends with said second line and at their outer ends with the periphery of said cavity so as to vent said cavity along said periphery.

* * * * *

UNITED STATES PATENT AND TRADEMARK OFFICE

CERTIFICATE OF CORRECTION

PATENT NO. : 5,119,886

DATED : June 9, 1992

INVENTOR(S) : Leroy S. Fletcher; George P. Peterson, Jr.

It is certified that error appears in the above-indentified patent and that said Letters Patent is hereby corrected as shown below:

Column 22, line 5 "heat" should be -- heated --.

Column 22, line 41 "an" should be -- and --.

Signed and Sealed this

Thirty-first Day of August, 1993

*Attest:*

*Attesting Officer*

BRUCE LEHMAN

*Commissioner of Patents and Trademarks*